US011756756B2

(12) United States Patent
Falkingham et al.

(10) Patent No.: US 11,756,756 B2
(45) Date of Patent: Sep. 12, 2023

(54) VACUUM INTERRUPTER WITH DOUBLE LIVE SHIELD

(71) Applicant: S&C Electric Company, Chicago, IL (US)

(72) Inventors: Leslie T. Falkingham, Rugby (GB); Keith W. Benson, Chicago, IL (US); Jason R. Bogusz, Chicago, IL (US); Gregory Wilk, Chicago, IL (US); Kam Wa Cheng, Stafford (GB); Subir Chakraborty, Chicago, IL (US); Gabrielle Madden, Chicago, IL (US); Francis Gotanco, Chicago, IL (US)

(73) Assignee: S&C Electric Company, Chicago, IL (US)

( * ) Notice: Subject to any disclaimer, the term of this patent is extended or adjusted under 35 U.S.C. 154(b) by 0 days.

(21) Appl. No.: 17/677,883

(22) Filed: Feb. 22, 2022

(65) Prior Publication Data

US 2022/0270837 A1 Aug. 25, 2022

Related U.S. Application Data

(60) Provisional application No. 63/153,659, filed on Feb. 25, 2021.

(51) Int. Cl.
*H01H 33/664* (2006.01)
*H01H 33/662* (2006.01)

(52) U.S. Cl.
CPC .... *H01H 33/664* (2013.01); *H01H 33/66261* (2013.01)

(58) Field of Classification Search
CPC ..... H01H 33/662; H01H 33/66261; H01H 33/664; H01H 2033/66269;
(Continued)

(56) References Cited

U.S. PATENT DOCUMENTS 3,430,015 A * 2/1969 Crouch ..... H01H 1/0203 218/139
3,727,018 A * 4/1973 Wesoloski ..... H01H 33/66207 218/124
(Continued)

FOREIGN PATENT DOCUMENTS

DE 19603081 * 7/1997 ..... H01H 33/66261

OTHER PUBLICATIONS

Translation of DE19603081 (Original document published Jul. 24, 1997) (Year: 1997).*

*Primary Examiner* — William A Bolton

(57) ABSTRACT

A vacuum interrupter including a cylindrical insulator, a first end cap sealed to one end of the insulator and a second end cap sealed to an opposite end of the insulator to provide a vacuum chamber. The vacuum interrupter further includes a fixed contact stem extending through the first end cap and having a contact positioned within the chamber, and a movable contact stem extending through the second end cap and having a contact portion positioned within the chamber. A first vapor shield is formed around the fixed contact stem so as to define a gap between the fixed contact and the insulator and a second vapor shield is formed around the movable contact so as to define a gap between the movable contact and the insulator.

9 Claims, 2 Drawing Sheets

(58) Field of Classification Search
CPC ..... H01H 2033/66276; H01H 2033/66284; H01H 2033/66292; H01H 33/24; H01H 33/122
USPC ..... 218/118, 134–140, 146–147
See application file for complete search history.

(56) References Cited

U.S. PATENT DOCUMENTS

| | | | | | |
|---|---|---|---|---|---|
| 4,215,255 | A * | 7/1980 | Kimblin | H01H 33/66261 | 218/136 |
| 4,249,050 | A * | 2/1981 | Okumura | H01H 33/66261 | 218/147 |
| 4,424,427 | A * | 1/1984 | Gebel | H01H 33/66261 | 218/136 |
| 4,481,390 | A * | 11/1984 | Kashiwagi | H01H 33/66261 | 218/135 |
| 6,891,122 | B2 * | 5/2005 | Renz | H01H 33/66261 | 218/136 |
| 9,281,145 | B2 * | 3/2016 | Wang | H01H 33/66261 | |
| 9,335,378 | B2 * | 5/2016 | Ledbetter | H01F 27/28 | |
| 10,134,546 | B2 * | 11/2018 | Li | H01H 33/6606 | |
| 2015/0070868 | A1 * | 3/2015 | Shang | H01H 33/66261 | 29/428 |

* cited by examiner

VACUUM INTERRUPTER WITH DOUBLE LIVE SHIELD

CROSS-REFERENCE TO RELATED APPLICATION

This application claims the benefit of priority from the U.S. Provisional Application No. 63/153,659, filed on Feb. 25, 2021, the disclosure of which is hereby expressly incorporated herein by reference for all purposes.

BACKGROUND

Field

This disclosure relates generally to a vacuum interrupter and, more particularly, to a vacuum interrupter that includes a cylindrical vapor shield formed around a fixed contact stem and a cylindrical vapor shield formed around a movable contact stem in the interrupter that are configured so that metal vapor caused by arcing between the contacts is prevented from collecting on end regions of an outer insulator.

Discussion of the Related Art

Vacuum interrupters are typically used in many types of devices for load and fault current interruption in medium voltage distribution systems. A vacuum interrupter typically includes a cylindrical insulator usually a ceramic and end caps sealed to the ends of the insulator to form a vacuum chamber or bottle. A fixed contact is electrically coupled to and extends through one of the end caps into the vacuum chamber and a movable contact is electrically coupled to and extends through the other end cap into vacuum chamber. When the contacts are in contact with each other current can flow through the vacuum interrupter. When the movable contact is moved away from the fixed contact, such as under a spring force, a plasma arc is created between the contacts that is quickly extinguished by the vacuum through a zero current crossing. The separated contacts in vacuum provides dielectric strength that exceeds power system voltage and prevents current flow, and the insulator prevents current flow between the end caps outside of the contacts.

When the contacts are separated the plasma causes metal vapor to be emitted from the contacts and condense on an inside surface of the insulator. After a certain number of vacuum interrupter opening cycles the metal vapor emitted by the arcing creates a conductive metal coating on an inside surface of the insulator, and thus provides a conduction path in parallel with the contacts, which prevents the vacuum interrupter from operating properly. In many vacuum interrupter designs, an annular vapor shield is provided between the contacts and the insulator at a central location, i.e., does not extend the entire length of the insulation housing, where the top and bottom ends of the shield are turned towards the contacts to cause the metal vapor to collect on the shield and not on the inside of the insulator.

Such vapor shield designs are often complex and costly in that the vapor shield is usually attached to the insulator by an extended annular tab that is at a floating voltage that tends toward a voltage between that of the two contacts, which requires the insulator to be separated into two halves. In this type of design, the floating electrical connection of the vapor shield causes the shield to be capacitively charged at a different voltage potential, usually about half, than the energized contact. Thus, in order to prevent electrical breakdown and conduction between the energized contact and the shield and then the grounded contact and the shield, thus creating a conductive path between the contacts, the vapor shield needs to be far enough away from the contacts to prevent the breakdown, which significantly increases the diameter of the vacuum chamber, and thus the interrupter.

In an alternate design, the vapor shield is electrically coupled to one of the conductive end caps of the interrupter and extends down into the chamber between the contacts and the insulator. However, in this design, the voltage potential between the contact connected to the other end cap and the shield is at full system potential, which requires an even greater distance between the contact and the shield. If the diameter of the vacuum interrupter can be reduced, then certain switchgear assemblies can be smaller and lighter and more vacuum interrupters can be placed in a vacuum furnace during production that provides vacuum evacuation and joint sealing to maintain the vacuum in the interrupter.

SUMMARY

The following discussion discloses and describes a vacuum interrupter including a cylindrical insulator, a first end cap sealed to one end of the insulator and a second end cap sealed to an opposite end of the insulator to provide a vacuum chamber. The vacuum interrupter further includes a fixed contact stem extending through the first end cap and having a contact portion positioned within the chamber, and a movable contact stem extending through the second end cap and having a contact portion positioned within the chamber, where the contacts contact each other when the vacuum interrupter is closed and do not contact each other when the vacuum interrupter is open. A first cylindrical vapor shield is formed around the fixed contact stem so as to define a gap between the fixed contact and the insulator and a second cylindrical vapor shield is formed around the movable contact so as to define a gap between the movable contact and the insulator, where the first and second vapor shields are configured so as to control the size of the gaps so that metal vapor caused by arcing between the first and second contact portions is prevented from traveling completely through the gaps and collecting on end regions of the insulator.

Additional features of the disclosure will become apparent from the following description and appended claims, taken in conjunction with the accompanying drawings.

DETAILED DESCRIPTION OF THE EMBODIMENTS

The following discussion of the embodiments of the disclosure directed to a vacuum interrupter including a cylindrical vapor shield formed around each contact in the interrupter that are configured so that metal vapor caused by arcing between the contacts condenses is limited from collecting on end regions of an outer insulator is merely exemplary in nature, and is in no way intended to limit the disclosure or its applications or uses.

Figure 1:
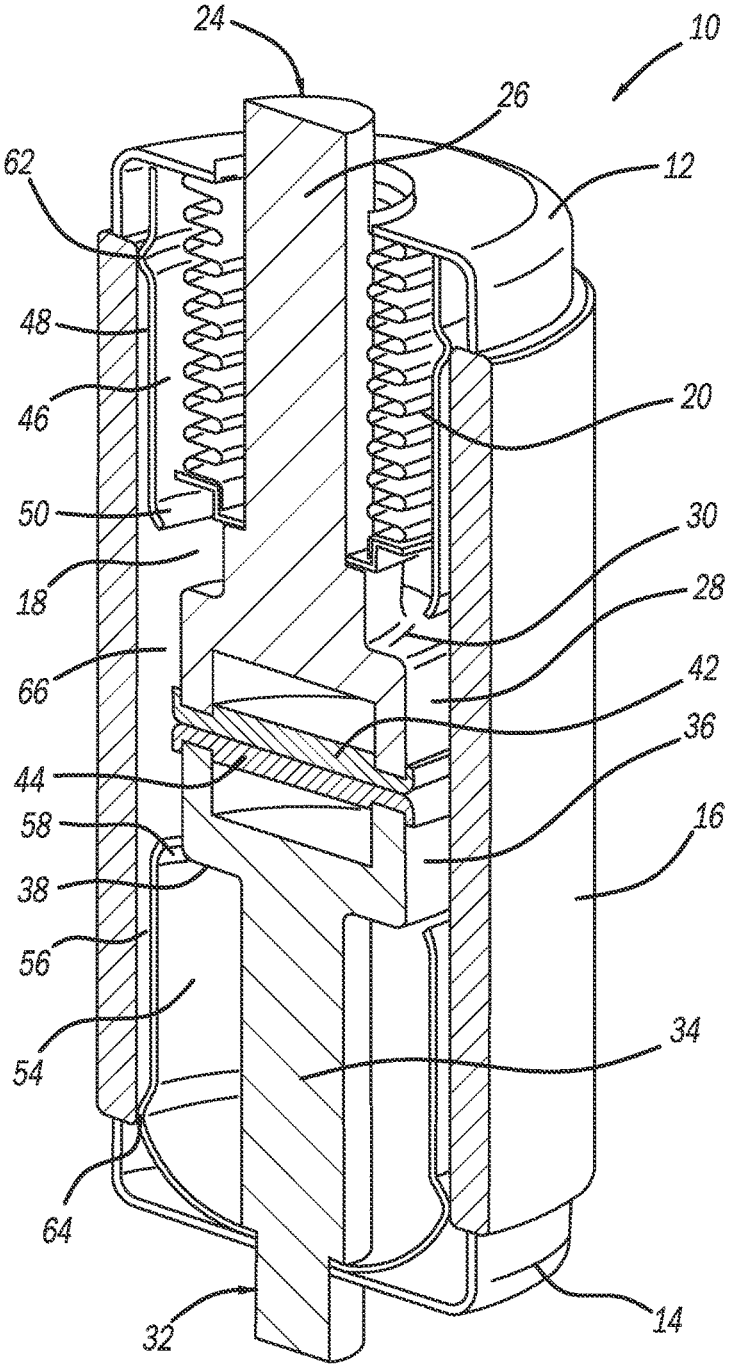
FIG. 1 is an isometric cross-sectional type view of a vacuum interrupter including a vapor shield positioned around a contact stem at each end of an outer ceramic insulator, where the vacuum interrupter is shown in a closed position.
Figure 2:
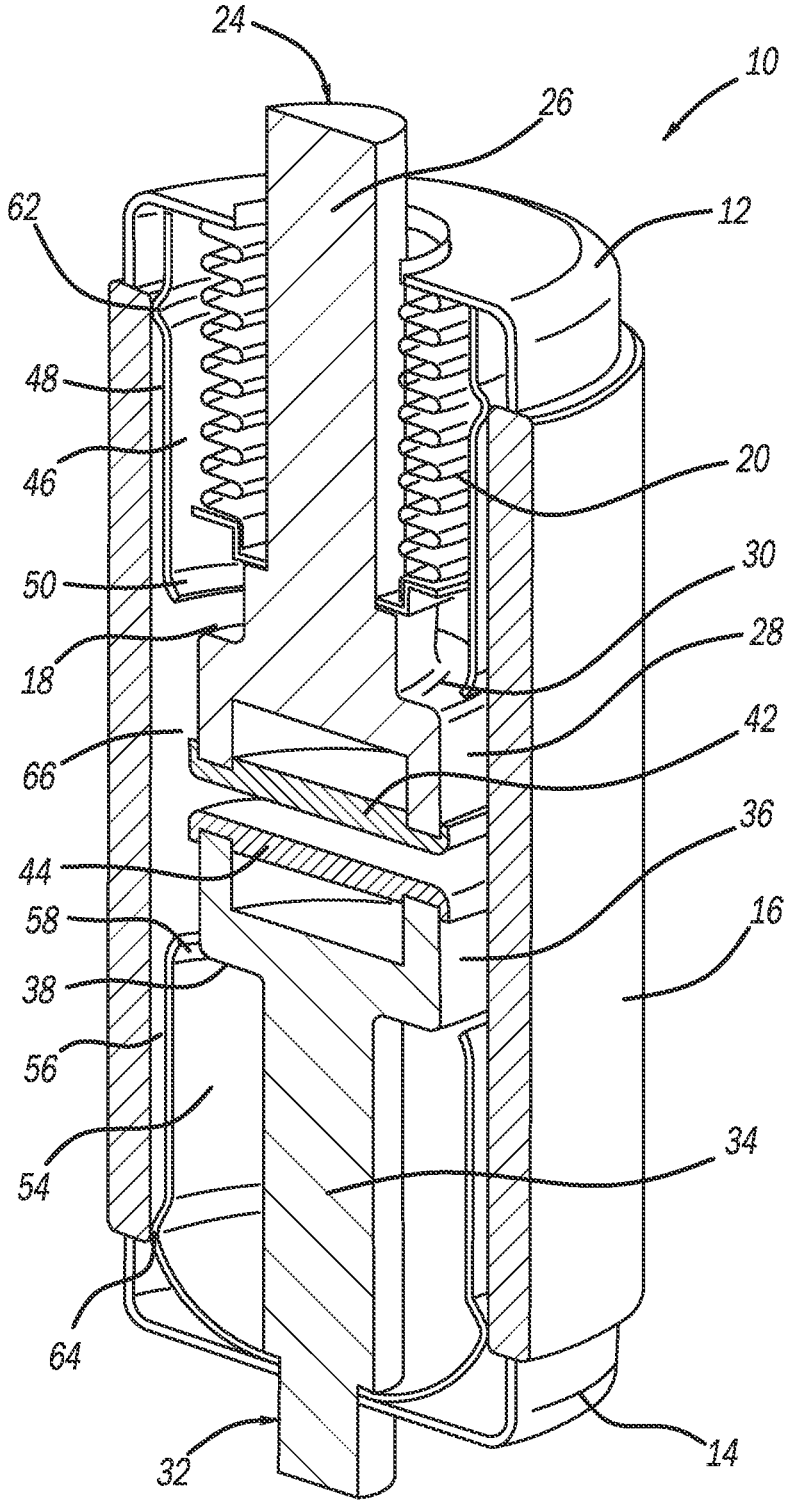
FIG. 2 is an isometric cross-sectional type view of the vacuum interrupter shown in FIG. 1, where the vacuum interrupter is shown in an open position.

FIGS. 1 and 2 are isometric cross-sectional type views of a vacuum interrupter 10 that is applicable to be employed in various types of switching devices used in in a medium voltage distribution network, where the vacuum interrupter 10 is shown in a closed position in FIG. 1 and an open position in FIG. 2. The interrupter 10 includes a top metallic end cap 12, a bottom metallic end cap 14 and a cylindrical ceramic insulator 16 extending therebetween and being sealed typically by brazing to the end caps 12 and 14 to define a vacuum chamber 18. A metallic bellows 20 is electrically coupled to the end cap 12 and is positioned within the chamber 18. A movable contact stem 24 is electrically coupled and sealed to the bellows 20 and extends through the bellows 20 into the chamber 18, where the stem 24 includes a shaft portion 26 and a cup portion 28 defining a shoulder 30 therebetween, and where the bellows 20 maintains the vacuum within the chamber 18 when the stem 24 moves. Likewise, a fixed contact stem 32 is electrically coupled and sealed to the end cap 14 and extends through the end cap 14 into the chamber 18, where the stem 32 includes a shaft portion 34 and a cup portion 36 defining a shoulder 38 therebetween.

An arcing contact 42 is electrically secured to the cup portion 28 and an arcing contact 44 is electrically secured to the cup portion 36 so that a gap is defined therebetween when the vacuum interrupter 10 is open. When the vacuum interrupter 10 is closed, the contacts 42 and 44 are held in contact with each other under a spring bias and when the vacuum interrupter 10 is opened, the stem 24 moves the contact 42 away from the contact 44, thus creating a plasma arc that is interrupted at the next zero current crossing due to the current interrupting capability of the vacuum, which causes metal vapor from the contacts 42 and 44 to be emitted into the chamber 18.

A cylindrical vapor shield 46 is formed around the bellows 20 and is electrically coupled to the end cap 12 in a configuration so that a narrow gap 48 is provided between the insulator 16 and the shield 46. An edge 50 of the shield 46 proximate the cup portion 28 is angled towards the shaft portion 26 to reduce concentrated electric field points and reduce the chance of a high voltage electrical breakdown and a ridge 62 is provided proximate an edge of the insulator 16 to locate the shield 46 relative to the insulator 16 and set the width of the gap 48. Likewise, a cylindrical vapor shield 54 is formed around the shaft portion 34 and is electrically coupled to the end cap 14 in a configuration so that a narrow gap 56 is provided between the insulator 16 and the shield 54. An edge 58 of the shield 54 proximate the cup portion 36 is angled towards the shaft portion 34 to reduce concentrated electric field points and reduce the chance of a high voltage electrical breakdown and a ridge 64 is provided proximate an end edge of the insulator 16 to locate the shield 54 relative to the insulator 16 and set the width of the gap 56. It is noted that the shield 46 does not extend into the plane of the contact 42 and the shield 54 does not extend into the plane of the contact 44 when the vacuum interrupter 10 is in the open position. The shields 46 and 54 can be a stamped metal made out of any suitable conductive material, such as stainless steel, copper, etc., and can be secured to the end caps 12 and 14 in any suitable manner, such as by welding, brazing, press fit, fixed by retaining rings, etc. In alternate embodiments, the shields 46 and 54 can also be attached to the insulator 16 or the contact stems 24 and 32.

The metal vapor emitted by the contacts 42 and 44 when the interrupter 10 is opened collects on an inside surface 66 of the insulator 16 between the shields 46 and 54. Some of the metal vapor enters the gaps 48 and 56, but since the gaps 48 and 56 are narrow, the vapor quickly lands on the shields 46 and 54 and the surface 66 of the insulator 16 and condenses, and thus does not travel significantly through the gaps 48 and 56 towards the end caps 12 and 14. Hence, ends of the insulator 16 do not become conductive and thus there is no conduction between the end caps 12 and 14 through the conductive coating on the inside surface 66 of the insulator 16. Therefore, the insulating integrity of the insulator 16 is maintained over repeated openings of the vacuum interrupter 10. Further, the metal coated center area of the insulator 16 is at a floating potential and, because of symmetry, has a voltage that is roughly half of the applied voltage to the interrupter 10, which reduces the electric field on the contact stems 24 and 32 and the shields 46 and 54 by two times that of a conventional shield. The length of the shields 46 and 54 and the size of the gaps 48 and 56 are controlled so that the size of the area at the ends of the insulator 16 is large enough to prevent conduction, but the size of the gaps 48 and 56 are not too small where electrical breakdown would occur between the metal vapor conductive layer on the inside surface 66 of the insulator 16 and the shields 46 and 54.

The foregoing discussion discloses and describes merely exemplary embodiments of the present disclosure. One skilled in the art will readily recognize from such discussion and from the accompanying drawings and claims that various changes, modifications and variations can be made therein without departing from the spirit and scope of the disclosure as defined in the following claims.

What is claimed is:

1. A vacuum interrupter comprising:

an insulator including a first end and a second end;

a first end cap sealed to the first end of the insulator and a second end cap sealed to the second end of the insulator, where the insulator, the first end cap and the second end cap define a vacuum chamber;

a fixed contact including a shaft electrically coupled to the first end cap and a first contact portion positioned within the chamber;

a movable contact including a shaft electrically coupled to the second end cap by a flexible bellows and a second contact portion positioned within the chamber, wherein the first and second contact portions contact each other when the vacuum interrupter is in a closed position and do not contact each other when the vacuum interrupter is in an open position;

a first vapor shield positioned within the insulator and around the fixed contact so as to define a first annular gap between the first vapor shield and the insulator, wherein the first vapor extends axially within the insulator from the first end of the insulator to a first edge recessed from a plane of the first contact portion; and a second vapor shield positioned within the insulator and around the movable contact so as to define a second annular gap between the second vapor shield and the insulator, wherein the second vapor extends axially within the insulator from the second end of the insulator to a second edge recessed from a plane of the second contact portion when the moving contact is in the open position defining an annular space between the first vapor shield and the second vapor shield about the first contact portion and the second contact portion to permit metal vapor caused by arcing between the first contact portion and the second contact portion to be communicated to a surface of the insulator, and wherein the first annular gap and the second annular gap are configured so as to inhibit communication of metal vapor caused by arcing between the first and second contact portions traveling completely through the first annular gap and the second annular gap and collecting on the first end and the second end of the insulator.

2. The vacuum interrupter according to claim 1 wherein the first and second edges are angled toward the first contact portion and the second contact portion, respectively.

3. The vacuum interrupter according to claim 1 wherein the first and second vapor shields each include a ridge positioned against the first or second end of the insulator, respectively, to set the size of the first and second annular gaps.

4. The vacuum interrupter according to claim 1 wherein the first and second vapor shields are made of a stamped or machined metal.

5. The vacuum interrupter according to claim 1 wherein the first vapor shield is electrically coupled to the first end cap and the second vapor shield is electrically coupled to the second end cap.

6. The vacuum interrupter according to claim 5 wherein the first and second vapor shields are brazed, welded, press fit or fixed by retaining rings to the first and second end caps.

7. The vacuum interrupter according to claim 1 wherein the insulator is a ceramic insulator.

8. The vacuum interrupter according to claim 1 wherein the insulator and the first and second vapor shields are cylindrical.

9. The vacuum interrupter according to claim 1 wherein the vacuum interrupter is part of a switching device employed in a medium voltage distribution network.

* * * * *